United States Patent [19]

Weeter

[11] 4,235,289

[45] Nov. 25, 1980

[54] METHOD FOR PRODUCING CARBON DIOXIDE FROM SUBTERRANEAN FORMATIONS

[75] Inventor: Robert F. Weeter, Carrollton, Tex.

[73] Assignee: Mobil Oil Corporation, New York, N.Y.

[21] Appl. No.: 38,034

[22] Filed: May 10, 1979

[51] Int. Cl.[2] ..... E21B 43/16

[52] U.S. Cl. ..... 166/267; 166/68

[58] Field of Search ..... 166/314, 68, 68.1, 266, 166/267, 105, 106, 268

[56] References Cited

U.S. PATENT DOCUMENTS

| | | | |
|---|---|---|---|
| 3,442,332 | 5/1969 | Keith | 166/266 |
| 3,887,008 | 6/1975 | Canfield | 166/68 X |
| 4,007,787 | 2/1977 | Cottle | 166/267 |

OTHER PUBLICATIONS

Frick, *Petroleum Production Handbook,* vol. 1, *Mathematics and Production Equipment,* McGraw-Hill Book Co., Inc., N.Y., 1962, pp. 13-1 to 13-9.

Environmental Impact Assessment for the Wasson Field-Denver Unit $CO_2$ Project (Draft), Woodward-Clyde Consultants, Jul. 1978, pp. 1-1 to 1-29.

Renfro, "Sheep Mountain $CO_2$ Production Facilities-A Conceptual Design", SPE 7796, presented at 1979 Production Operations Symposium of SPE of AIME, Oklahoma City, Okla., Feb. 25-27, 1979, 10 pages.

*Primary Examiner*—Stephen J. Novosad

*Attorney, Agent, or Firm*—C. A. Huggett; Drude Faulconer

[57] ABSTRACT

A method for producing substantially pure carbon dioxide in a single phase at the surface from a subterranean formation. A pump means, e.g., electrically driven, submergible, centrifugal pump system, is positioned downhole in a carbon dioxide production well. The carbon dioxide flows from the formation to the inlet of the pump means wherein the carbon dioxide is compressed to raise the pressure to values greater than the critical pressure of the produced carbon dioxide plus the amount of pressure that the carbon dioxide will lose due to (a) the static fluid head above the pump means and (b) flow friction from the pump means to a central processing and compression station on the surface. By so boosting the pressure within the well, the carbon dioxide will be produced at the surface at a pressure greater than the critical pressure of the produced carbon dioxide, thereby insuring the carbon dioxide will be in a single phase, supercritical state.

8 Claims, 3 Drawing Figures

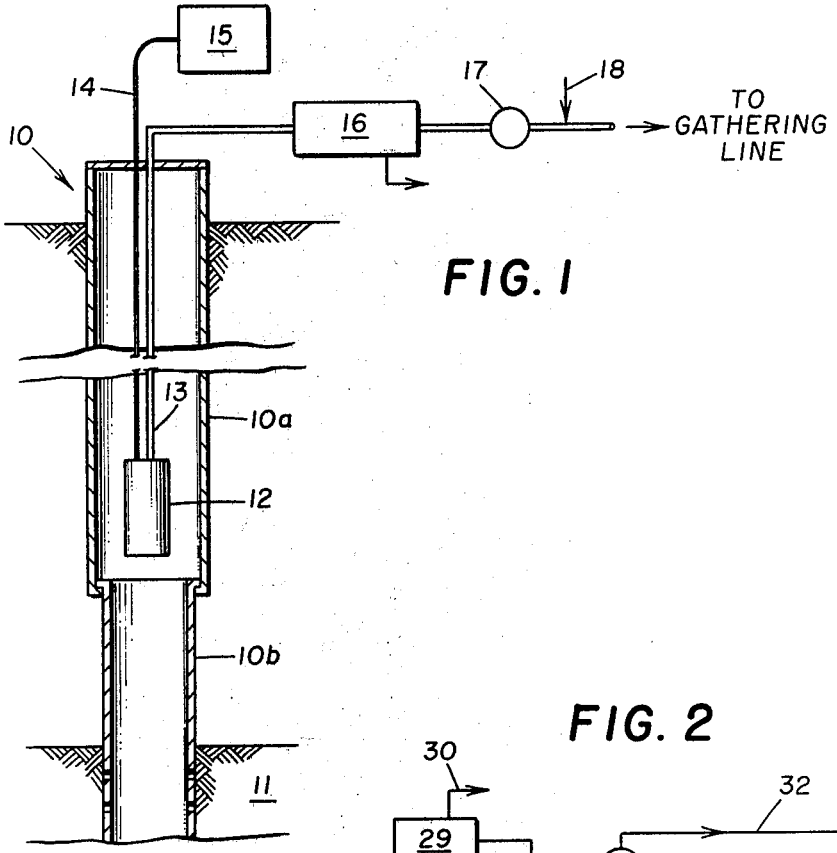
FIG. 1
FIG. 2
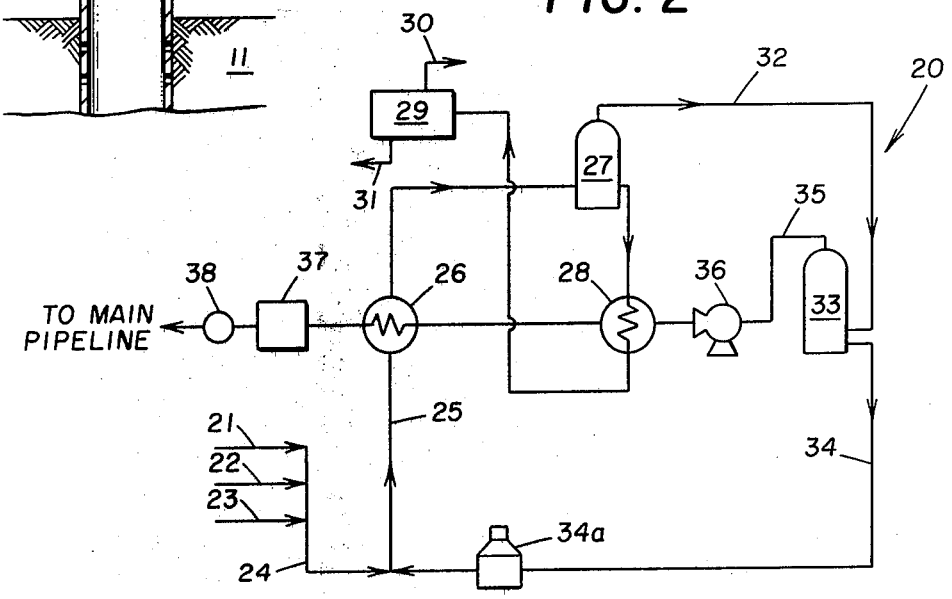

CARBON DIOXIDE

METHOD FOR PRODUCING CARBON DIOXIDE FROM SUBTERRANEAN FORMATIONS

BACKGROUND OF THE INVENTION

The present invention relates to the production of carbon dioxide from a subterranean formation and more particularly relates to the production of carbon dioxide from a subterranean formation so that it will arrive at the surface in a single, supercritical phase.

It has long been recognized that carbon dioxide may be injected into an oil-bearing formation during a secondary or tertiary enhanced recovery operation to produce additional amounts of oil. One of the most attractive sources for carbon dioxide for this purpose is natural subterranean formations which produce large volumes of almost pure carbon dioxide. Unfortunately, many of the known formations capable of producing carbon dioxide in quantities sufficient for enhanced oil recovery operations are located several hundred miles from the oil fields in which the carbon dioxide is to be used. Accordingly, the carbon dioxide must be gathered from the carbon dioxide producing wells, treated, and then pipelined the several hundred miles to its final destination.

Due to the physical properties of carbon dioxide, it normally arrives at the surface from a production well in a two-phase state. As is known, flowing such a two-phase fluid through a pipeline over long distances of varying elevations creates a fluid "hammer" effect which is likely to cause serious damage to the pipeline and related equipment as well as considerable loss of horsepower. Therefore, the carbon dioxide has to be gathered and processed at or near the production wells and delivered to the pipeline as a single phase fluid, either gas, liquid, or supercritical fluid.

To do this, it has been proposed to position a central processing and compression station near several producing wells wherein the carbon dioxide from the well is heated, treated, and compressed for entry into the main pipeline. However, since a central processing and compression station will normally have to be located up to ten miles from some of the producing wells, a problem still exists in flowing the normally two-phase carbon dioxide from a production well to the central station through a gathering line, especially if the gathering line runs over hilly terrain.

At present, two known proposals have been made for gathering carbon dioxide from production wells and flowing it to a central processing station. First, if the production rates of carbon dioxide from a well are relatively small, small diameter flowlines, e.g., 3-inch, may be used as gathering lines so that any "hammer" effect caused by two-phase flow can be tolerated. Second, if production rates are large, thereby requiring large diameter, e.g., 10-inch, gathering lines, line heaters are to be provided at each producing wellhead to heat the produced carbon dioxide to thereby convert the liquid phase of the carbon dioxide into vapor before the carbon dioxide is delivered into the gathering line.

In the latter proposal, however, the amount of fuel needed to operate the line heater will be substantial and in addition to the costs involved, the actual logistics required to maintain a ready supply of fuel to the well sites at remote locations will present real problems.

SUMMARY OF THE INVENTION

The present invention provides a method for producing carbon dioxide from a production well so that the carbon dioxide arrives at the surface in a single phase state. This allows the produced carbon dioxide to be delivered to a large diameter gathering line without requiring any expensive conversion of the carbon dioxide to single phase at each wellhead.

More specificially, a pump means is positioned within a producing well. Carbon dioxide flows from the producing formation up the well to the intake of the pump means, e.g., an electrically driven, submergible, multistage centrifugal pump system. The pressure of the carbon dioxide is boosted by compression within the pump means to a value greater than the critical pressure for the carbon dioxide plus the amount of pressure the carbon dioxide will lose due to the static fluid head above the pump means and the pressure that will be lost due to friction in flowing the carbon dioxide to the surface and from the production well to a central processing and compression station. The pump means discharges the carbon dioxide into a production tubing in the well through which it is produced to the surface. The carbon dioxide arrives at the surface at a pressure and temperature greater than the critical pressure and temperature of the produced carbon dioxide, thereby insuring that the carbon dioxide is produced in a single phase, supercritical state. Further, since the pressure was increased downhole by a value which allowed for friction losses in the gathering line, the produced carbon dioxide will arrive at the central station in a single phase state.

The single phase carbon dioxide is passed through a separator to remove any liquid water that may be present and a hydrate inhibitor is added before the produced carbon dioxide is delivered to the gathering line for flow to the central processing and compression station. By delivering the carbon dioxide to the station in a single phase state and under relatively high pressure, only single stage compression at the central station is normally required to boost the carbon dioxide up to the pressure, e.g., 2000 psig, needed for flow through the main pipeline to its final destination.

BRIEF DESCRIPTION OF THE DRAWINGS

The actual operation and apparent advantages will be better understood by referring to the drawings in which:

FIG. 1 is a sectional view of a carbon dioxide production well embodying the present invention;

FIG. 2 is a schematical view of a central processing and compression station used with the present invention.

DESCRIPTION OF THE PREFERRED EMBODIMENT

Figure 3:
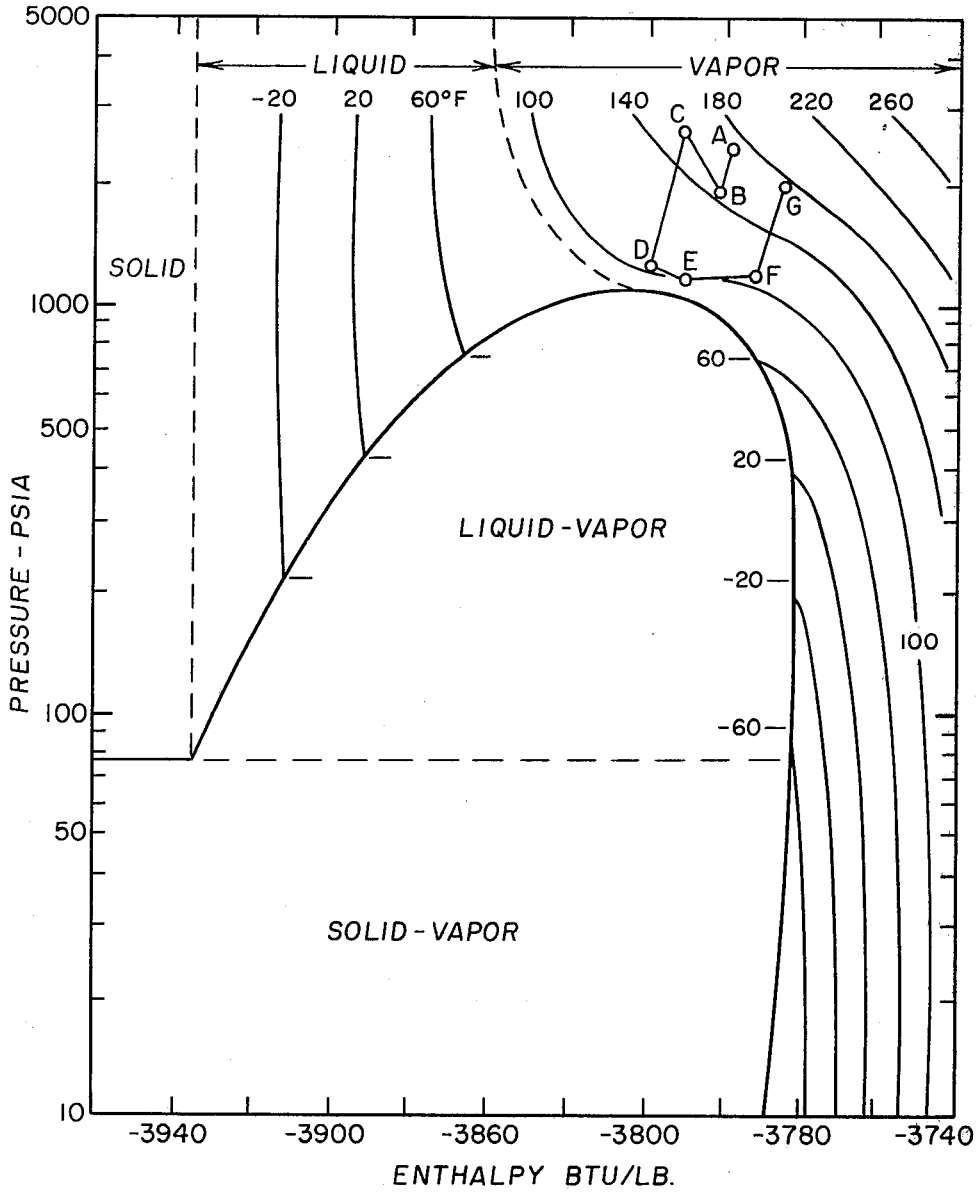
FIG. 3 is a simplified, carbon dioxide pressure-enthalpy diagram having flow conditions of an example of the present invention thereon.

Formations capable of producing carbon dioxide in the qualities and quantities necessary for use in enhanced oil recovery operations normally have pore pressures sufficient to cause the carbon dioxide to flow to the surface without requiring the use of any artificial lift means, such as a downhole pump. However, the carbon dioxide expands as it flows upward in a well, thereby reducing the pressure of the carbon dioxide so that it normally arrives at the wellhead at a pressure at which the carbon dioxide exists as a two-phase fluid. Where the production rate of a well is low, this two-phase fluid can be flowed through small diameter, e.g., 3-inch, gathering lines to a central processing and compression station without much difficulty. However, where the production rate of the well is high enough to require the use of large diameter gathering lines, e.g., 10-inch, two-phase carbon dioxide must be treated at the wellhead to convert it into a single phase before it can be delivered to a gathering line.

In accordance with the present invention, carbon dioxide is produced from a well in such a manner that it will arrive at the surface in a single phase state, thereby allowing it to be delivered into a gathering line without the need for any conversion treatment at the wellhead.

Referring more particularly to the drawings, FIG. 1 discloses a well 10 which has been completed into a carbon dioxide producing formation 11. A pump means 12 is lowered on production tubing 13 to a specified depth in well 10 which will be explained in greater detail below. Preferably pump means 12 is a submergible electrically driven, multistage centrifugal pump system, such as is commercially available from TRW Reda, a Division a TRW, Inc., Bartlesville, OK. This electrical power cable 14 is run with pump means 12 into well 10 as is well known in the art and is connected to control means 15 at the surface. As will be explained in more detail below, the carbon dioxide flowing up well 10 from formation 11 is picked up by pump means 12 and pumped to the surface through tubing 13 so that it arrives at the wellhead at a pressure sufficient to maintain the carbon dioxide in a single-phase, supercritical state. The produced supercritical carbon dioxide is flowed through a separator 16 to remove any liquid water that may be present, through a means 17 for measuring the produced carbon dioxide, e.g. orifice meter, and into a gathering line (not shown) for delivery to central processing and compression station 20 (FIG. 2). A hydrate inhibitor or drying agent, e.g. ethylene glycol, may be added to the carbon dioxide through line 18 before it enters the gathering line, to prevent hydrate formation from damaging the gathering line.

Now looking at FIG. 2, central processing and compression station 20 will be briefly described. Although the details of station 20 form no part of the present invention, the description thereof will be helpful in fully understanding all of the advantages of the present invention. Carbon dioxide from gathering lines 21, 22, 23, flows into header 24, through line 25, and through heat exchange 26 into glycol reclaimer 27 where the previously added hydrate inhibitor, e.g. ethylene glycol, is recovered from the carbon dioxide vapor. The glycol is removed from reclaimer 27 and is flowed through heat exchanger 28 into glycol reboiler 29 where any water vapor is vented through line 30 and the recovered glycol is removed for storage or reuse through line 31.

The carbon dioxide flows through line 32 from reclaimer 27 into liquid scrubber 33 where liquid carbon dioxide, if any, is removed. Scrubber 33 is to insure no liquid is fed to compressor 36. The liquid carbon dioxide, if any, is flowed through line 34 and heater 34*a* back to line 25 for recycle through station 20. Supercritical carbon dioxide is flowed through line 35 from scrubber 33 to compressor 36 wherein the pressure of the carbon dioxide is boosted to that required for flow through the main pipeline. The compressed carbon dioxide flows from compressor 36 through heat exchangers 28, 26, respectively, to cool the compressed gas and to utilize within the process operation the heat given up by the compressed carbon dioxide. The carbon dioxide then passes through additional cooling means 37, if desired, and through a measuring means 38, e.g. orifice meter, before it is delivered into the main pipeline (not shown) for flow to its final destination. By delivering the carbon dioxide to station 20 in single phase, the processing operation is substantially simplified and one full stage of compression may be eliminated. This amounts to substantial savings in the overall process.

To further illustrate the present invention, an actual propsed field application will be described in detail, again referring to the figures. Well 10 is completed with 7-inch casing 10*a* to a depth of approximately 6500 feet and a 5-½ inch liner 10*b* from 6500 feet to a depth of approximately 8100 feet. Liner 10*b* is perforated adjacent formation 11 which has an original formation pressure of approximately 2400 psi. Well 10 is killed by filling it with water and pump means 12 is run in on 3-inch tubing 13 to a depth of approximately 6000 feet. Pump means 12 is preferably an electrically driven, multistage centrifugal pump system such as a 100 Stage, G-220, 540 Series Pump, manufactured by TRW Reda, a Division of TRW, Inc., Bartlesville, OK. This pump system is capable of developing 3450 rpms at 60 cycles and may be driven at different rpms to develop different maximum pump displacements by using a phase convertor at the surface to supply current at different frequencies to the pump motor. As will be explained in more detail below, this allows a single pump system to produce varying pump rates to compensate for declining formation pressure over the production life of the well. The electric power cable 14 is run into well 10 with pump means 12.

With pump means 12 in place, the water is pumped from well 10 and is discarded. As the water in well 10 is removed, carbon dioxide from formation 11 will flow up well 10. The carbon dioxide in formation 11 will be at approximately 2400 psig pressure and 167° F. temperature, but will expand as it flows upward so that it will arrive at pump means at approximately 1890 psig and 146° F. If the carbon dioxide were allowed to flow unaided to the surface, it would arrive at 835 psig and 68° F., this being below the critical pressure and temperature at which carbon dioxide will exist in single phase. Therefore, it would arrive at the surface in a two-phase state.

It will be understood by those skilled in phase behavior that the exact critical temperature and pressure below which produced carbon dioxide will exist in a two-phase state can and must be determined from the actual composition of the carbon dioxide being produced. For example, the critical pressure and temperature above which pure or 100 percent carbon dioxide will exist in a single phase, supercritical state is 1071 pounds per square inch absolute (psia) and 88° F. However, some produced carbon dioxide may contain minor amounts of contaminants, e.g. nitrogen, which will slightly alter the critical pressure and/or temperature at which the carbon dioxide will have to arrive at the surface to insure single phase supercritical production. Therefore, the terms "critical pressure" and "critical temperature" as used herein shall mean the pressure and temperature of carbon dioxide being produced, based on its actual composition including any contaminants, above/either of which the produced carbon dioxide will exist in a single, supercritical state and below/both of which it will exist in a two-phase state.

Pump means 12 will pick up the carbon dioxide at 6000 feet in well 10 at 1890 psig and 146° F. and boost the pressure by approximately 739 psig and, hence the temperature by approximately 24° F. so that carbon dioxide will be delivered to tubing 13 at the pump outlet at approximately 2630 psig and 170° F. Flow upward through production tubing 13 will again reduce the pressure and temperature of the carbon dioxide due to the static fluid head (1254 psig) and flow friction losses (6% of static head or 75 psig) above pump means 12 (total pressure loss of 1329 psig) but, due to the boost in pressure and temperature from pump means 12, the carbon dioxide will still arrive at the surface at approximately 1300 psig and 100° F., this being sufficiently above the critical pressure and critical temperature (i.e, 1080 psia and 88° F.) necessary to keep the carbon dioxide in a single phase, supercritical state even during flow through the gathering line to the central station 20.

The flow sequence just described will be more fully understood by referring to FIG. 3. Point A on the simiplified carbon dioxide, pressure-enthalpy chart represents the temperature and pressure of the carbon dioxide in formation 11 of the above example. As the carbon dioxide flows to point B (location of pump means 12 in well 10), it can be seen that it drops in both temperature and pressure but that the carbon dioxide remains in the single phase, supercritical region. At point B, pump means 12 boosts the pressure, and hence, the temperature of the carbon dioxide to point C (outlet of pump means 12) from which it flows upward through tubing 13 to point D (surface), arriving at point D at a pressure and temperature still well within the single phase supercritical region. The carbon dioxide will reduce slightly in pressure due to friction loss in the gathering lines as it flows to station 20 (point E) where it can be heated, if desired, to point F before compressing the carbon dioxide with single stage compression to a pressure, i.e., 2000 psig, (point G) necessary to flow the carbon dioxide through the main pipeline to its final destination. It will be noted that the produced carbon dioxide remains in a single phase, supercritical state at all times and never enters the two-phase region.

In determining where to position pump means 12 in well 10, it is only necessary to determine what the pressure of carbon dixoide will be at the inlet of pump means 12 and that this pressure plus the pressure boost added by pump means 12 will be greater than critical pressure of the carbon dioxide taking into account contaminants plus the losses due to the static fluid head and the flow friction from pump means 12 to central station 20. The important consideration is that the pressure added by pump means 12 to the pump inlet pressure of the carbon dioxide will allow for loss of pressure due to the static fluid head and flow friction above pump means 12 and still produce the carbon dioxide at the surface at a pressure above the critical pressure and temperature of the produced carbon dioxide.

As mentioned above, it is preferable to use a pump means 12 which can be operated at different pump capacities. For example, the example of pump means 12 given above can operate at greater pump capacities when electricity is delivered at 70 hertz to the pump motor than at 60 hertz. By use of a phase-converter at the surface, pump means 12 can be operated at 60 hertz during the early production cycle when a lesser pressure boost is needed and then can be operated at 70 hertz in the later production cycle when a greater pressure boost is needed due to declining formation pressure, and hence, declining pump inlet pressure. By so using such a pump means 12, the need to change the size and type of pump means 12 during the production life of well 10 is eliminated.

From the above description, it can be seen that the present invention provides a method for producing carbon dioxide in a single phase state which eliminates the need for expensive conversion operations of two-phase carbon dioxide to single-phase at each wellhead before delivering the carbon dioxide to gathering lines. Also, by producing the carbon dioxide in a single phase, one stage of expensive compression equipment in the central station may be eliminated in most, if not all, operations.

What is claimed is:

1. A method for producing carbon dioxide in a single phase state at the surface from a subterranean formation through a well completed into said formation, said method comprising:

boosting the pressure of said carbon dioxide at a depth in said well to a value sufficient to allow the pressure of said carbon dioxide to be reduced by an amount equal to the static fluid head and friction loss in the well above said depth and still produce said carbon dioxide at the surface at a pressure greater than the critical pressure of the produced carbon dioxide.

2. The method of claim 1 wherein:

said pressure of said carbon dioxide is boosted by compressing said carbon dioxide at said depth in said well.

3. The method of claim 2 wherein:

said carbon dioxide is compressed by a pump means positioned at said depth in said well.

4. The method of claim 3 wherein said pump means comprises:

an electrically driven, submergible, multistage centrifugal pump system.

5. The method of producing carbon dioxide in a single phase state from a subterranean formation to a central processing and compression station, said method comprising:

completing a well into said subterranean formation;

positioning a pump means within said well;

allowing carbon dioxide to flow from said subterranean formation to the inlet of said pump means;

compressing said carbon dioxide in said pump means to boost the pressure of said carbon dioxide to a value greater than the critical pressure of the produced carbon dioxide plus (a) the pressure exerted by the static fluid head above said pump means and (b) the pressure loss due to friction flow from said pump means to a central processing and compression station at the surface;

producing said compressed carbon dioxide from said pump means to said surface at a pressure greater than the critical pressure of the produced carbon dioxide; and flowing said carbon dioxide to said central processing and compression station at a pressure greater than the critical pressure of the produced carbon dioxide.

6. The method of claim 5 wherein said pump means comprises:

an electrically driven, submergible, multistage centrifugal pump system.

7. The method of claim 5 including:

removing any free water from said compressed carbon dioxide before said produced carbon dioxide is flowed to said central processing and compression station.

8. The method of claim 7 including:

adding a hydrate inhibitor to said produced carbon dioxide before said produced carbon dioxide is flowed to said central processing and compression station.

* * * * *